US005963769A

United States Patent [19]

Emukai et al.

[11] Patent Number: 5,963,769

[45] Date of Patent: Oct. 5, 1999

[54] MULTICOLOR IMAGE FORMING APPARATUS

[75] Inventors: Tetsurou Emukai; Keiji Sasaki; Noribumi Sato; Akihiro Yamashita, all of Saitama, Japan

[73] Assignee: Fuji Xerox Co., Ltd., Tokyo, Japan

[21] Appl. No.: 09/126,107

[22] Filed: Jul. 30, 1998

[30] Foreign Application Priority Data

Jul. 31, 1997 [JP] Japan ..... 9-218978

[51] Int. Cl.[6] ..... G03G 15/16

[52] U.S. Cl. ..... 399/297; 399/301; 399/302; 399/345

[58] Field of Search ..... 399/301, 297, 399/298, 302, 313, 345, 101

[56] References Cited

U.S. PATENT DOCUMENTS 5,438,398 8/1995 Tanigawa et al. ..... 399/302
5,822,666 10/1998 Haneda et al. ..... 399/309

FOREIGN PATENT DOCUMENTS 4-318886 11/1992 Japan .
5-72912 3/1993 Japan .

*Primary Examiner*—Arthur T. Grimley
*Assistant Examiner*—Greg Moldafsky
*Attorney, Agent, or Firm*—Finnegan, Henderson, Farabow, Garrett & Dunner, L.L.P.

[57] ABSTRACT

In a multicolor image forming apparatus, an intermediate transfer belt is moved at a first speed. A secondary transfer roll is pressed against the intermediate transfer belt at the time of secondary transfer in order to secondarily transfer a multicolor toner image on the intermediate transfer belt onto recording paper. The secondary transfer roll is rotated by a driving unit including a gear unit at a peripheral speed higher than the first speed. A torque limiter limits the driving torque of the secondary transfer roll pressed against the intermediate transfer belt to the load torque of the secondary transfer roll separated from the intermediate transfer belt. Consequently, the secondary transfer roll is rotated at a speed equal to or slightly higher than the speed of the intermediate transfer belt and the load of the secondary transfer roll applied to the intermediate transfer belt never exceeds a predetermined value.

9 Claims, 5 Drawing Sheets

MULTICOLOR IMAGE FORMING APPARATUS

BACKGROUND OF THE INVENTION

1. Field of the Invention

The present invention relates to a multicolor image forming apparatus, and more particularly to a multicolor image forming apparatus suitable for preventing color slippage when a multicolor image is obtained by superimposing a plurality of monochromatic toner images.

2. Description of the Related Art

In image forming apparatus such as copying machines, facsimiles, printers and the like utilizing electrophotography, the surface of an image carrier uniformly charged with electricity by a charger is irradiated with laser beam so as to form an electrostatic latent image and a development device is then used to convert this latent image into a toner image. Then, this toner image is transferred directly or indirectly onto a printing medium (hereinafter referred to as "recording paper") such as paper and plastic film sheets before being outputted as a printed image.

A typical multicolor image forming apparatus is provided with two image carriers and a plurality of monochromatic toner images formed on the first image carrier are superimposed on the second image carrier (hereinafter referred to as "intermediate transfer body") so as to form a multicolor toner image, which is then transferred onto recording paper.

In order to transfer the multicolor toner image from the intermediate transfer body onto the recording paper as the secondary transfer in a multicolor image forming apparatus of the sort described above, a transfer roll is provided opposite to the intermediate transfer body. This transfer roll is pressed against the intermediate transfer body only at the time of secondary transfer and separated therefrom at the time of other than the secondary transfer. Consequently, the intermediate transfer body is subjected to shock when the transfer roll is pressed against the intermediate transfer body and this may cause color slippage of the image.

In the case of an electrophotographic apparatus as disclosed in Japanese Patent Unexamined Publication No. Hei. 5-72912, torque is given to the transfer roll from a driving source through a so-called one-way clutch capable of transmitting the torque only in one direction and the peripheral speed of the transfer roll is set to be lower than the speed of the intermediate transfer body. The clutch is released and the transfer roll is urged by the intermediate transfer body to undergo so-called free-running because the speed of the intermediate transfer body is greater than the peripheral speed of the transfer roll when the transfer roll is brought into contact with the intermediate transfer body. Consequently, the peripheral speed of the transfer roll becomes equal to the speed of the intermediate transfer body, whereupon it is anticipated that the shock received by the intermediate transfer body is eased when both are brought into contact with each other.

The following problem is posed in the aforesaid conventional apparatus. The free-running of the transfer roll caused by the intermediate transfer body means that the self-inertia acceleration torque and the frictional torque of the transfer roll act on the intermediate transfer body. Therefore, the load of the intermediate transfer body will differ between the time when the transfer roll is kept in contact with the intermediate transfer body and the time other than the former. In other words, the load fluctuates between the secondary transfer to the recording paper and the time other than the secondary transfer. On the other hand, the transfer of the monochromatic toner image from the first image carrier to the intermediate transfer body, that is, the primary transfer, is carried out irrespective of whether or not the secondary transfer is being carried out. Consequently, the problem is that the monochromatic toner image subjected to the primary transfer during the secondary transfer may shift in position from the monochromatic toner image subjected to the primary transfer not during the secondary transfer, resulting in color slippage of the multicolor image. Since the cleaning blade is pressed against the transfer roll in order to clean the surface of the transfer roll, the load derived from the frictional resistance of the cleaning blade also constitutes the load applied to the intermediate transfer body indirectly and this also causes color slippage to the multicolor image like the above-described problem.

A cleaning means, that is, a cleaner for removing residual toner (waste toner) on the intermediate transfer body is provided and when the cleaner is pressed against the intermediate transfer body, the load fluctuation of the intermediate transfer body is produced. A brush-like cleaner may be considered in order to lower the frictional resistance between the cleaner and the intermediate transfer body but this also results in the problem of not only complicating the mechanism but also increasing the cost.

SUMMARY OF THE INVENTION

An object of the present invention is to solve the foregoing problems and to provide a multicolor image forming apparatus capable of preventing the color slippage of a multicolor image by reducing the load fluctuation of an intermediate transfer body.

In order to achieve the foregoing object, the present invention provides a multicolor image forming apparatus for forming a multicolor toner image by superimposing monochromatic toner images that have been subjected to a primary transfer on an intermediate transfer body and for subjecting the multicolor toner image to a secondary transfer to a printing medium in order to obtain a desired multicolor image, the multicolor image forming apparatus comprising: first driving means for moving the intermediate transfer body at a first speed for image formation; a secondary transfer roll which is pressed against the intermediate transfer body at the time of the secondary transfer in order that the multicolor toner image is secondarily transferred to the printing medium; second driving means for rotating the secondary transfer roll at a peripheral speed higher than the first speed; and torque limiting means for limiting a driving torque of the secondary transfer roll resulting from the second driving means while the secondary transfer roll is pressed against the intermediate transfer body to a load torque of the secondary transfer roll while the secondary transfer roll is separated from the intermediate transfer body.

Further, the invention provides a multicolor image forming apparatus for forming a multicolor toner image by superimposing monochromatic toner images that have been subjected to a primary transfer on an intermediate transfer belt and for subjecting the multicolor toner image to a secondary transfer to a printing medium in order to obtain a desired multicolor image, the multicolor image forming apparatus comprising: a driving roll and a plurality of driven rolls among which the intermediate transfer belt is stretched; first driving means for moving the intermediate transfer belt at a first speed for image formation; cleaning means which is pressed against one of the driven rolls via the intermediate transfer belt in order to clean a surface of the intermediate transfer belt; second driving means for rotating the one driven roll at a peripheral speed higher than the first speed; and clutch means which is included in the second driving means and adapted to connect power to the one driven roll when the load is increased by pressing the cleaning means against the one driven roll and to cut the transmission of the power to the one driven roll when the load is decreased by separating the cleaning means from the one driven roll.

Furthermore, the invention provides a multicolor image forming apparatus for forming a multicolor toner image by superimposing monochromatic toner images that have been subjected to a primary transfer on an intermediate transfer belt and for subjecting the multicolor toner image to the secondary transfer to a printing medium in order to obtain a desired multicolor image, the multicolor image forming apparatus comprising: a driving roll and a plurality of driven rolls among which the intermediate transfer belt is stretched; first driving means for moving the intermediate transfer belt at a first speed for image formation; a load limiting driven roll which is disposed between a driven roll disposed in a secondary transfer position and a driven roll disposed in the following stage, and kept in contact with the intermediate transfer belt stretched between the two driven rolls; cleaning means which is pressed against the road limiting driven roll via the intermediate transfer belt in order to clean a surface of the intermediate transfer belt; and second driving means for rotating the load limiting driven roll at a predetermined peripheral speed greater than the first speed by what is equivalent to a reduction in the speed of the intermediate transfer belt which is increased by press load derived from the cleaning means.

DETAILED DESCRIPTION OF THE PREFERRED EMBODIMENTS

Figure 5:
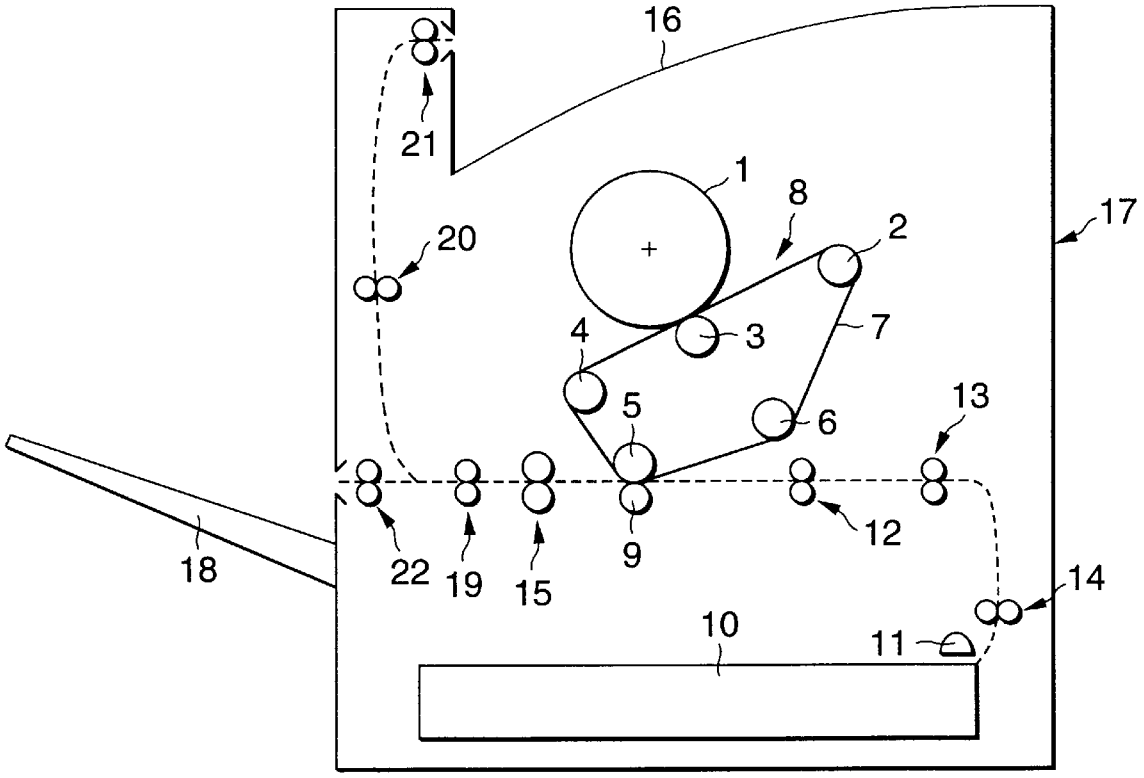
FIG. 5 is a sectional view of the image forming apparatus.

A detailed description will subsequently be given of embodiments of the invention with reference to the drawings. FIG. 5 is a schematic sectional view of a multicolor image forming apparatus embodying the invention. As shown in FIG. 5, known parts (not shown) for use in forming electrophotographic images such as a charger, a laser scanner, a development device, a cleaner and the like are disposed around a drum-like photoreceptor 1. The photoreceptor 1 is uniformly charged with electricity by the charger, and the laser scanner irradiates the photoreceptor 1 with laser beam modulated according to image data, whereby an electrostatic latent image is formed. The electrostatic latent image thus formed is developed with toner of a predetermined color in the development device.

An intermediate transfer unit 8 including a plurality of rolls 2, 3, 4, 5 and 6 and a transfer belt 7 as an intermediate transfer body stretching among these rolls is so disposed as to adjoin the photoreceptor 1. The primary transfer roll 3 is pressed against the photoreceptor 1 via the transfer belt 7 and used to transfer a toner image on the photoreceptor 1 to the transfer belt 7 (primary transfer) by charging the transfer belt 7 opposite in polarity to the toner.

On the other hand, a secondary transfer roll 9 is disposed opposite to the roll 5 with the transfer belt 7 held therebetween in order to transfer the toner image on the transfer belt 7 onto a sheet of recording paper conveyed to a position between the secondary transfer roll 9 and the roll 5, that is, a secondary transfer position. The sheet of recording paper are contained in a paper feed cassette 10 in such a way that the sheets of paper are stacked up therein and are sent out successively from the uppermost one by means of a paper feed roll 11.

The sheet of recording paper taken out of the paper feed tray 11 is conveyed to the secondary transfer position through a conveyance path (indicated by the dotted line) on which a pair of registration rolls 12, a pair of pre-registration rolls 13 and a pair of conveyor rolls 14 are arranged up to the secondary transfer position. The toner image on the transfer belt 7 is transferred onto the sheet of recording paper at the secondary transfer position due to the action of the secondary transfer roll 9. The toner image transferred onto the sheet of recording paper is heat-fixed by a pair of fixing rolls 15 before being discharged onto an outlet tray 16, that is, the top of an image forming apparatus 17 or an outlet tray 18. The outlet tray 16 is a so-called face-down tray where the transferred-image carrying side of the sheet of recording paper thus discharged is in a turned-over state, whereas the outlet tray 18 is a so-called face-up tray where the transferred-image carrying side thereof is in a turned-up state. The printed sheet of recording paper is conveyed by the pairs of rolls 19, 20 and 21 to the outlet tray 16. On the other hand, the printed sheet of recording paper is conveyed by the pairs of rolls 19 and 22 to the outlet tray 18. A conveyance-path switching gate (not shown) is provided on the downstream side of the pair of rolls 19 in order to determine whether to select the face-down or face-up.

In the aforesaid image forming apparatus, toner images, which are formed in the order of Y, M, C and K colors on the photoreceptor 1, are transferred onto the transfer belt 7 in the primary transfer position where the primary transfer roll 3 is situated opposite to the photoreceptor 1. On the transfer belt 7 exists one or a plurality of sheets of toner image simultaneously depending on the size of the image. In the case of a small-sized image, for example, toner images equivalent to two pages are simultaneously formed at a time. With respect to an image on the preceding page in the above case, for example, even assuming that all of the toner images of Y, M, C and K on the transfer belt 7 have completely been superimposed and that their secondary transfer onto the recording paper is started, the primary transfer has not yet been completed at that point of time as long as the next page is concerned. In other words, it may occur that the toner image of K color as the last color is being subjected to the primary transfer after the primary transfer of only the toner images of Y, M and C colors concerning the next page is terminated. It may also occur that the primary transfer of the toner image of Y color as the initial color concerning another next page is started during the secondary transfer onto the next page after the secondary transfer onto the preceding page is terminated. Thus, the toner images of Y and K colors are subjected to the primary transfer during the secondary transfer, whereas the toner images of C and M colors are subjected to the primary transfer while the secondary transfer is not carried out.

The secondary transfer roll 9 is pressed against the transfer belt 7 during the secondary transfer and the secondary transfer roll 9 is separated from the transfer belt 7 while the secondary transfer is not carried out. Therefore, the load applied to the transfer belt 7 fluctuates between the time during which the secondary transfer is carried out and the time during which the secondary transfer is not carried out. Consequently, there may occur slippage between the position where the toner images of Y and K colors are subjected to the primary transfer during the secondary transfer and the position where the toner images of C and M colors are subjected to the primary transfer while the secondary transfer is not carried out, thus making impossible desired color development.

Figure 2:
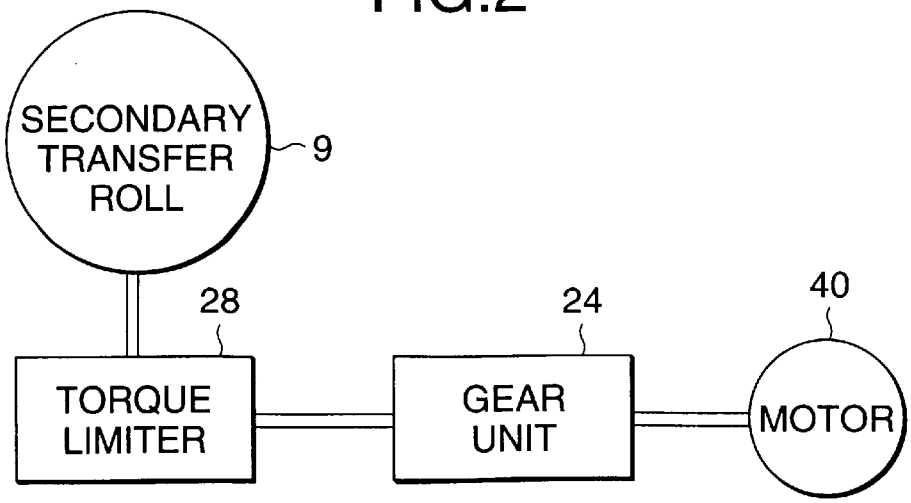
FIG. 2 is a drive system diagram of a secondary transfer roll.

Then, the following arrangement is employed to obviate the slippage between the toner images in this embodiment of the invention. FIG. 2 is a system diagram illustrating the driving of the secondary transfer roll 9 installed for obviating the slippage between the toner images of different colors. In FIG. 2, the rotation of a motor 40 is reduced by a gear unit 24 and the rotation thus reduced is transmitted to the secondary transfer roll 9 via a torque limiter 28 as a torque limiter means. In this case, a set value TL of the transmission torque of the torque limiter 28 is greater than the load torque T2 of the secondary transfer roll 9 (TL>T2) and (TL−T2) is made preferably as small as possible. Further, the motor 40, the gear unit 24 and the diameter of the secondary transfer roll 9 are set so that the peripheral speed Vr of the secondary transfer roll 9 is slightly higher than the running speed Vb of the transfer belt 7 or otherwise at least not lower than the running speed Vb of the transfer belt 7. The torque and speed setting will be more fully discussed later.

Figure 1:
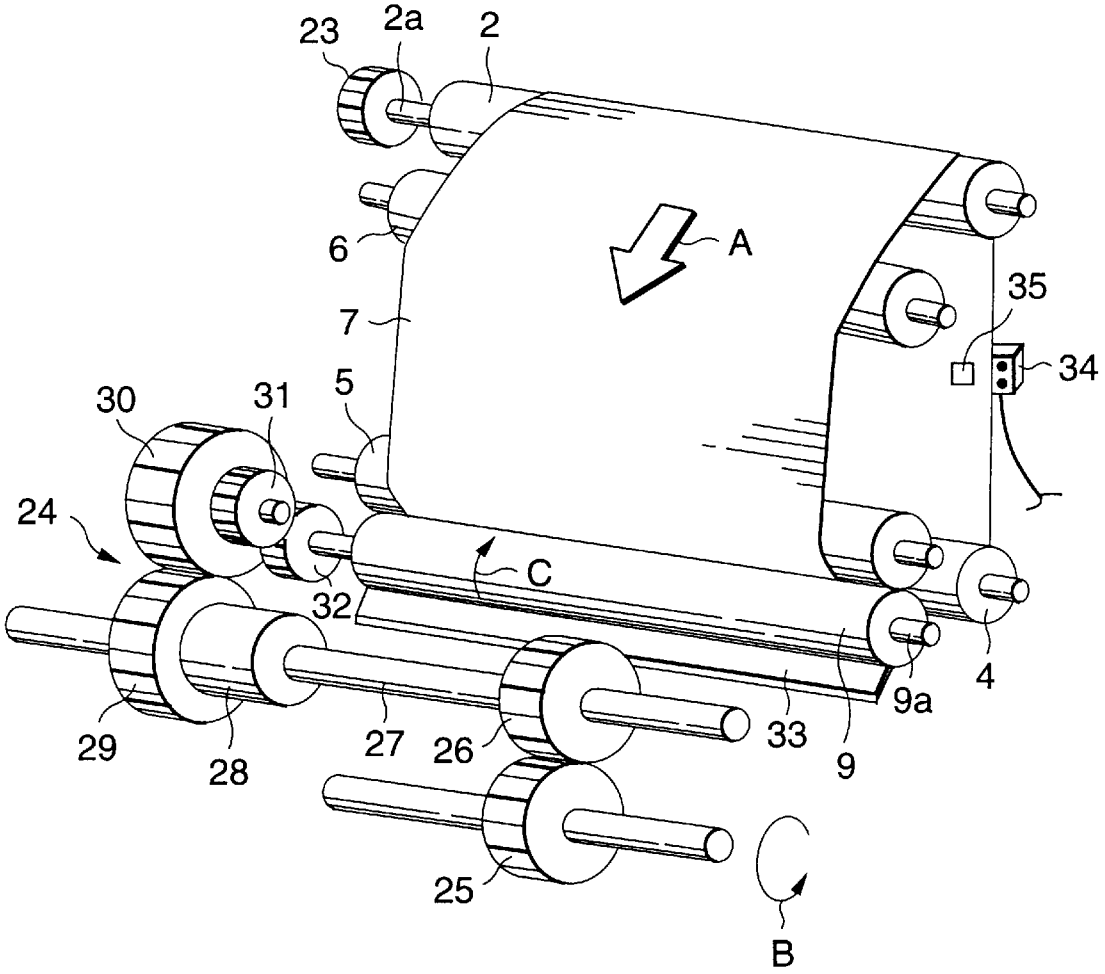
FIG. 1 is a perspective view of an intermediate transfer unit included in a multicolor image forming apparatus as a first embodiment of the invention.

A detailed description will subsequently be given of the construction and the operation of the intermediate transfer unit 8. FIG. 1 is a perspective view of the intermediate transfer unit 8. In FIG. 1, a gear 23 is secured to the end portion of the shaft 2*a* of the driving roll 2 and the torque is transmitted from a driving source (not shown) to the gear 23, whereby the transfer belt 7 stretched on the driving roll 2 runs in the direction of an arrow A.

On the other hand, the secondary transfer roll 9 is driven as follows. An input-stage gear 25 of the gear unit 24 is rotated in the direction of an arrow B by the aforesaid motor 40 which is different from the driving source for running the transfer belt 7. As the gear 25 is engaged with a next-stage gear 26, the torque is transmitted to a shaft 27 for holding the gear 26. The shaft 27 is provided with a gear 29 via the torque limiter 28 and the torque of the gear 29 is transmitted to a gear 30. The torque of the gear 30 is transmitted to a gear 32 via a small gear 31 which is integral with the gear 30. The gear 32 is secured to one end of the shaft 9*a* of the secondary transfer roll 9 and as the gear 32 rotates, the secondary transfer roll 9 is rotated in the direction of an arrow C. Further, a cleaning blade 33 for cleaning the secondary transfer roll 9 is kept in contact with the secondary transfer roll 9.

A sensor 34 for detecting the position of the transfer belt 7 is disposed at the end portion of the transfer belt 7. The sensor 34 is, for example, an optical sensor for detecting the presence or absence of the light reflected from the transfer belt 7 which has been irradiated with the light emitted from the sensor 34 itself, and used for outputting the variation of on/off of a light receiving signal at the position of a hole 35 formed in the transfer belt 7 as a position detecting signal for the transfer belt 7. A control unit (not shown) in the form of a microcomputer determines the position of a toner image on the transfer belt 7 according to the position detecting signal in order to obtain timing at which the toner image is transferred onto the recording paper. The secondary transfer roll 9 is separated from the transfer belt 7 until a multicolor toner image of Y, M, C and K colors is formed on the transfer belt 7 and pressed against the transfer belt 7 at the timing at which the multicolor toner image is transferred onto the recording paper.

When the load torque T2 of the secondary transfer roll 9 becomes equal to the set torque value or greater of the torque limiter 28, the torque limiter 28 is turned off and the torque of the motor transmitted via the gear 25 is not transmitted to the secondary transfer roll 9. When the load torque T2 has the set value or smaller, on the other hand, the torque limiter 28 is turned on and the secondary transfer roll 9 is rotated. However, the peripheral speed of the secondary transfer roll 9 is set so that it is at least not lower than the running speed of the transfer belt 7 as already noted above.

Figure 3:
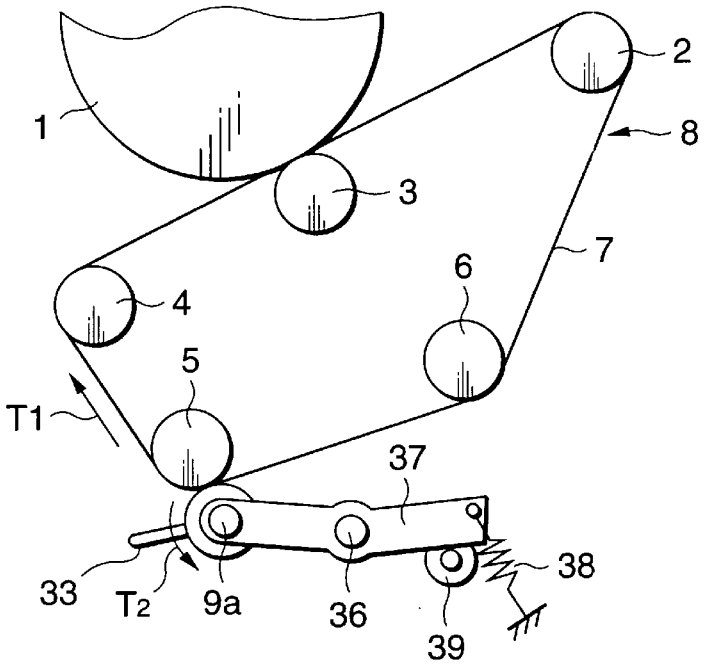
FIG. 3 is a side view of the principal part of the intermediate transfer unit in the first embodiment of the invention.
Figure 4:
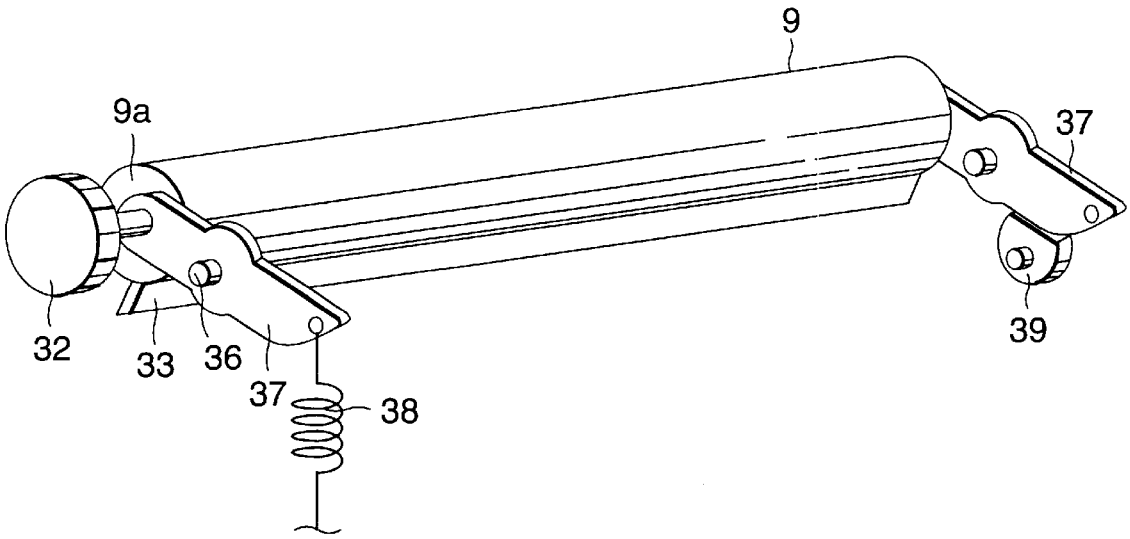
FIG. 4 is a perspective view of a secondary-transfer-roll pressing mechanism.

Subsequently, the relation between the transfer belt 7 and the torque of the secondary transfer roll 9 due to the above-described speed and torque setting will be explained. FIG. 3 is a side view of the principal part of the intermediate transfer unit 8, and FIG. 4 is a perspective view a secondary-transfer-roll pressing mechanism. The shaft 9*a* of the secondary transfer roll 9 is supported with one end of an arm 37 capable of swinging around a shaft 36 and urged clockwise by a spring 38 as shown in FIG. 3, the secondary transfer roll 9 being pressed against the transfer belt 7 by the force of the spring 38. The rotational shaft 36 of the arm 37 is a shaft common to that of the gears 30 and 31 or set at least to be coaxial therewith. Thus, the gear 31 is kept in engagement with the gear 32, irrespective of the pressed/separated state of the secondary transfer roll 9.

An eccentric cam 39 is disposed opposite to the other end of the arm 37, which is pressed by the spring 38 against the cam face of the eccentric cam 39 and swung as the eccentric cam 39 rotates. Therefore, the arm 37 is swung counter-clockwise when the eccentric cam 39 is so positioned that its radius is maximized, and the secondary transfer roll 9 is separated from the transfer belt 7.

While the transfer belt 7 is being driven in FIG. 3, torque T1 acts on the transfer belt 7, and the load torque T2 also acts on the secondary transfer roll 9. The load torque T2 is mainly produced because of the pressing of the cleaning blade 33. Thus, the torque T1 is caused to fluctuate with the following occasion since the load torque T2 acts on the torque T1 of the driven transfer belt 7 at the time of the secondary transfer but does not act on the transfer belt 7 at the time of other than the secondary transfer.

Figure 9:
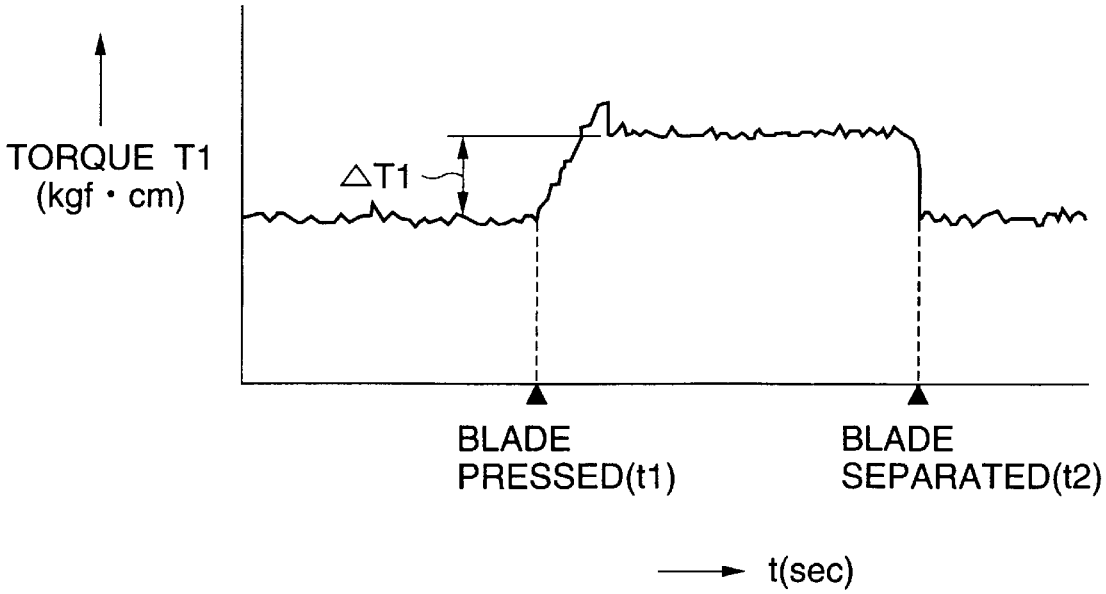
FIG. 9 is a graph showing the fluctuation of the driving torque of the intermediate transfer body.

FIG. 9 shows the fluctuation of the torque T1 caused by the pressed/separated state of the cleaning blade 33. As shown in FIG. 9, the value of the torque T1 fluctuates by ΔT1 between the time when the cleaning blade 33 is pressed (between t1 and t2) and the time when it is not.

In this embodiment, in order to decrease the fluctuating quantity ΔT1 of the torque T1, the secondary transfer roll 9 is driven by the motor 40 which is different from the driving source of the transfer belt 7 and its peripheral speed Vr is set to be higher than or at least not lower than the running speed vb of the transfer belt 7. With this arrangement, the load torque T2 produced by pressing the secondary transfer roll 9 can be made smaller and the fluctuation to which the torque T1 is subjected by the load torque becomes smaller. Although it is ideal to hold the peripheral speed Vr of the secondary transfer roll 9 to be identical to the running speed Vb of the transfer belt 7 all the time, it is actually difficult to do so. Consequently, the peripheral speed Vr of the secondary transfer roll 9 is set to be slightly higher than the running speed Vb of the transfer belt 7 in this embodiment.

The reason for the torque fluctuation ΔT1 to be reduced will be described more specifically. The difference in speed between the secondary transfer roll 9 and the transfer belt 7 makes the transfer belt 7 a load to the secondary transfer roll 9, thus causing the load torque T2 of the secondary transfer roll 9 to increase. When the load torque T2 exceeds the set value of the torque of the torque limiter 28, the linking of the torque limiter 28 is cut off and the load torque T2 is decreased because the secondary transfer roll 9 becomes undriven. Then, the linking of the torque limiter 28 is restored and the driving of the secondary transfer roll 9 is started. The repetition of this process limits the load torque T2 acting on the transfer belt 7 so that the load torque T2 is minimized. Consequently, the torque T1 less varies between the secondary transfer time when the load torque T2 acts on the transfer belt 7 and non secondary transfer time when the load torque T2 does not act of the transfer belt 7.

A description will subsequently be given of a second embodiment of the invention. A primary factor for causing the transfer belt 7 to fluctuate includes the pressing/separating of the secondary transfer roll 9 and also the pressing/separating of the cleaning blade with respect to the transfer belt 7. In the second embodiment, it is arranged that the fluctuation of the speed of the transfer belt 7 caused by pressing and separating the cleaning blade against and from the transfer belt 7 is made preventable.

Figure 6:
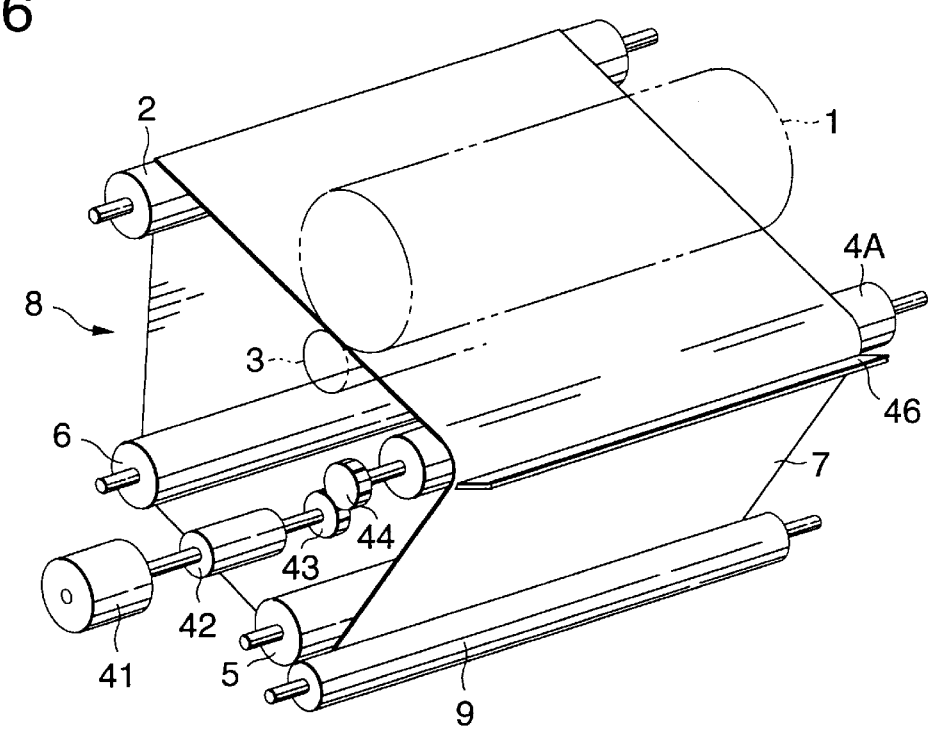
FIG. 6 is a perspective view of an intermediate transfer unit included in an image forming apparatus as a second embodiment of the invention.

FIG. 6 is a perspective view of an intermediate transfer unit 8 according to the second embodiment. In FIG. 6, a driven roll 4A is not an idle roll and is driven by a motor 41. The motor 41 may be what is common to a motor for driving the driving roll 2 or an exclusive one. The torque of the motor 41 is transmitted to a gear 44 secured to the shaft of the driven roll 4A via a clutch 42 as a torque limiting means and a gear 43. In this case, use can be made of a one-way clutch or a solenoid clutch as the clutch 42.

A cleaning blade 46 is disposed opposite to the driven roll 4A via the transfer belt 7 and pressed against and separated from the transfer belt 7 by a pressing/separating means (not shown). For example, after a toner image subjected to the primary transfer in the order of Y, M, C and K colors is secondarily transferred to recording paper, unnecessary toner is scraped off by pressing the cleaning blade 46 against the transfer belt 7. Although a combination of the cam and the spring as referred to in FIGS. 3 and 4 and another combination of a solenoid and a spring are considered to be usable as the pressing/separating means of the cleaning blade 46, the illustration of such a pressing/separating means is omitted because this means is not an essential subject in this embodiment.

After waste toner on the surface of the transfer belt 7 is scraped off by the cleaning blade 46 onto a catch pan (not shown), it is collected into a collector box 47 (FIG. 7) by a conveyor means such as an auger. The collector box 47 may be so installed as to adjoin the cleaning blade 46 and the catch pan or separate therefrom. Japanese Patent Unexamined Publication No. Hei. 4-318886 discloses a collector device adapted to carry waste toner into a collector box disposed at a position away from a catch pan.

Figure 7:
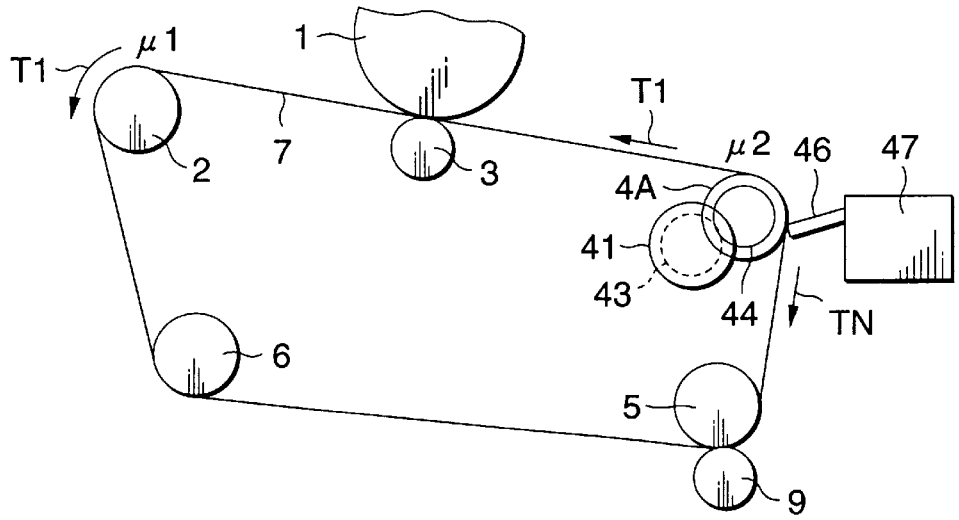
FIG. 7 is a side view of the principal part of the intermediate transfer unit in the second embodiment of the invention.

A description will be given of torque acting on the transfer belt 7 of the intermediate transfer unit 8 with reference to FIG. 7. In FIG. 7, the transfer belt 7 is driven by the torque T1 and when the cleaning blade 46 is pressed against the transfer belt 7, a drag TN acts thereon. Since the presence or absence of the drag TN results in causing the fluctuation of the speed of the transfer belt 7, the driven roll 4A is forced to be driven by the motor 41 so as to lower the drag TN. At this time, the peripheral speed of the driven roll 4A is set to be equal to or at least not lower than the peripheral speed of the driving roll 2.

When the cleaning blade 46 is pressed against the transfer belt 7 during the operation with the clutch 42 which is a one-way clutch, the load of the driven roll 4A is increased. Then, the speed of the driven roll 4A is decreased and the clutch 42 is engaged. Further, the driven roll 4A is forced to be driven by the motor 41 and the drag TN applied to the transfer belt 7 is reduced. When the cleaning blade 46 is separated from the transfer belt 7, on the other hand, the load applied to the driven roll 4A is reduced. Since the speed of the driven roll 4A is increased then, the clutch 42 is disengaged. At this time, the driven roll 4A is rotated as the transfer belt 7 runs. Thus, the peripheral speed of the driven roll 4A is controlled so that it is slightly higher than the speed of the transfer belt 7 or set equal to the peripheral speed of the transfer belt 7, irrespective of the pressing of the cleaning blade 46.

Therefore, the load applied to the transfer belt 7 can be made to less fluctuate between the time when the cleaning blade 46 is pressed against to the transfer belt 7 and the time when it is separated therefrom. The positioning of the clutch 42 is not limited to what is shown in FIG. 6, but may be chosen so that switching on and off of the driving force applied to the driven roll 4A from the motor 41 is made possible according to the load applied to the driven roll 4A; for example, the baring itself of the gear 43 or 44 may be a one-way clutch.

In the case where a solenoid clutch is employed as the clutch 42, moreover, a control unit is provided for supplying or stopping power to the solenoid clutch in accordance with timing at which the cleaning blade 46 is pressed/separated or in response to a signal for energizing a solenoid or a cam, for example. However, the driving force derived from the driven roll 4A is still an auxiliary to what is derived from the driving roll 2; that is, the transfer belt 7 must not be driven with driving force greater than what is derived from the driving roll 2. For this reason, the friction coefficient $\mu 1$ of the driving roll 2 should be greater than the friction coefficient $\mu 2$ of the driven roll 4A. Preferably, the driving roll 2 is made of urethane resin having a greater friction coefficient, whereas the driven roll 4A is made of aluminum offering an excellent surface finish, for example. Even though the same material is used, moreover, the friction coefficients can be differentiated by finishing the surface of the driving roll 2 rougher than that of the driven roll 4A.

Figure 8:
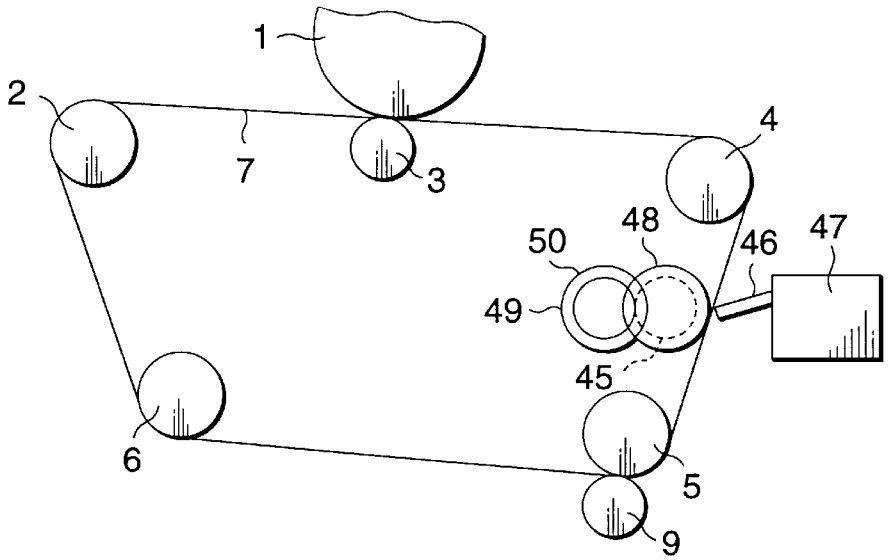
FIG. 8 is a side view of the principal part of an intermediate transfer unit in a third embodiment of the invention.

A third embodiment of the invention will subsequently be described. In FIG. 8, the transfer belt 7 of the intermediate transfer unit 8 is, as in the first embodiment of the invention, stretched among the driving roll 2, the driven rolls 4, 5 and 6 as idle rolls and the primary transfer roll 3. Further, a driven roll 48 for limiting the load, to which driving force is applied for forcible rotation, is brought into contact with the transfer belt 7 between the driven rolls 4 and 5. The cleaning blade 46 is pressed against the driven roll 48 via the transfer belt 7. As in the second embodiment, the cleaning blade 46 is also pressed against the transfer belt 7 in order to scrape off the toner thereon during the time the final K color is temporarily transferred onto the transfer belt 7, for example, and separated from the transfer belt 7 except for the scrape-off time above.

The driven roll 48 is kept being driven by a motor 50 via gears 45 and 49 all the time, irrespective of whether or not the cleaning blade 46 is pressed against the driven roll 48. The motor 50 may be what is common to the motor for driving the driving roll 2 or an exclusive one as in the second embodiment. The peripheral speed of the driven roll 48 is set to be equal to or slightly higher than the speed of the transfer belt 7 driven by the driving roll 2. In other words, the peripheral speed of the driven roll 48 is to have a predetermined value greater than the set speed of the transfer belt 7 by what is equivalent to a reduction in the speed of the transfer belt 7 increased by the load produced by the pressing of the cleaning blade. Incidentally, the driven roll 48 is still auxiliary to the driving roll 2 as in the second embodiment, whereupon the friction coefficient $\mu 3$ between the transfer belt 7 and the driven roll 48 is set to be smaller than the friction coefficient $\mu 1$ between the transfer belt 7 and the driving roll 2.

With the arrangement above, the driven roll 48 kept in contact with the portion of the transfer belt 7 stretched between the driven rolls 4 and 5 gives no load fluctuation to the transfer belt 7 during the time the cleaning blade 46 is not pressed against the driven roll 48. When the cleaning blade 46 is pressed against the driven roll 48, the load of the cleaning blade 46 is applied to the transfer belt 7. Since the driving force of the driven roll 48 acts on the transfer belt 7 by the pressing force of the cleaning blade 46 then, however, the load of the cleaning blade 46 is wiped out.

In the second embodiment, the load applied to the transfer belt 7 is reduced by intermittently rotating the driven roll 4A since the contact angle (grip angle) between the transfer belt 7 and the driven roll 4A is great enough to make the pressing force of the cleaning blade 46 a great drag with respect to the transfer belt 7. In the third embodiment, to the contrary, the pressing force of the cleaning blade 46 as a drag to the transfer belt 7 is extremely small because the driven roll 48 remains to merely linearly contact the transfer belt 7. Therefore, in the third embodiment, the load applied by the cleaning blade 46 to the transfer belt 7 can be reduced without providing any torque limiting means between the motor 50 and the driven roll 48 by setting the peripheral speed of the driven roll 48 to be slightly higher than the running speed of the transfer belt 7.

As is obvious from the above description, in the invention, the secondary transfer roll is rotated at a speed equal to or slightly greater than the speed of the intermediate transfer body, irrespective of whether the secondary transfer roll is pressed against the intermediate transfer body. Since the load of the secondary transfer roll applied to the intermediate transfer body does not become larger, the running speed of the intermediate transfer body less fluctuates, thus making it possible to lower the slippage of transfer positions among the monochromatic toner images at the time of primary transfer. Consequently, a high-quality multicolor image free from color slippage is obtainable.

What is claimed is:

1. A multicolor image forming apparatus for forming a multicolor toner image by superimposing monochromatic toner images that have been subjected to a primary transfer on an intermediate transfer body and for subjecting the multicolor toner image to a secondary transfer to a printing medium in order to obtain a desired multicolor image, said multicolor image forming apparatus comprising:

first driving means for moving the intermediate transfer body at a first speed for image formation;

a secondary transfer roll which is pressed against the intermediate transfer body at the time of the secondary transfer in order that the multicolor toner image is secondarily transferred to the printing medium;

second driving means for rotating said secondary transfer roll at a peripheral speed higher than the first speed; and torque limiting means for limiting a driving torque of said secondary transfer roll resulting from said second driving means while said secondary transfer roll is pressed against the intermediate transfer body to a load torque of said secondary transfer roll while said secondary transfer roll is separated from the intermediate transfer body.

2. The multicolor image forming apparatus according to claim 1, wherein said torque limiting means is a torque limiter for making said second driving means engage or disengage with said secondary transfer roll depending on whether or not the load torque of said secondary transfer roll at the time of the secondary transfer exceeds a predetermined quantity of load torque of said secondary transfer roll at the time of non-secondary transfer.

3. The multicolor image forming apparatus according to claim 1, further comprising cleaning means which is used for cleaning a surface of said secondary transfer roll and brought into contact with said secondary transfer roll.

4. A multicolor image forming apparatus for forming a multicolor toner image by superimposing monochromatic toner images that have been subjected to a primary transfer on an intermediate transfer belt and for subjecting the multicolor toner image to a secondary transfer to a printing medium in order to obtain a desired multicolor image, said multicolor image forming apparatus comprising:

a driving roll and a plurality of driven rolls among which the intermediate transfer belt is stretched;

first driving means for moving the intermediate transfer belt at a first speed for image formation;

cleaning means which is pressed against one of said driven rolls via the intermediate transfer belt in order to clean a surface of the intermediate transfer belt;

second driving means for rotating said one driven roll at a peripheral speed higher than the first speed; and clutch means which is included in said second driving means and adapted to connect power to said one driven roll when the load is increased by pressing said cleaning means against said one driven roll and to cut the transmission of the power to said one driven roll when the load is decreased by separating said cleaning means from said one driven roll.

5. The multicolor image forming apparatus according to claim 4, wherein the peripheral speed of said one driven roll is a predetermined speed greater than the first speed by what is equivalent to a reduction in the speed of the intermediate transfer belt which is increased by press load derived from said cleaning means.

6. The multicolor image forming apparatus according to claim 4, wherein said clutch means is a one-way clutch capable of transmitting torque only in one direction.

7. The multicolor image forming apparatus according to claim 4, wherein said clutch means is a solenoid clutch which is supplied or not supplied with power in response to an energizing signal for pressing/separating said cleaning means.

8. The multicolor image forming apparatus according to claim 4, wherein roughness of the surfaces of said driving roll and said one driven roll is set so that a friction coefficient between said one driven roll and the intermediate transfer belt is smaller than a friction coefficient between said driving roll and the intermediate transfer belt.

9. A multicolor image forming apparatus for forming a multicolor toner image by superimposing monochromatic toner images that have been subjected to a primary transfer on an intermediate transfer belt and for subjecting the multicolor toner image to a secondary transfer to a printing medium in order to obtain a desired multicolor image, said multicolor image forming apparatus comprising:

a driving roll and a plurality of driven rolls among which the intermediate transfer belt is stretched;

first driving means for moving the intermediate transfer belt at a first speed for image formation;

a load limiting driven roller disposed between two driven rolls, one of said driven rolls disposed at a secondary transfer position, and said load limiting roller kept in contact with the intermediate transfer belt stretched between said two driven rolls;

cleaning means which is pressed against said load limiting driven roll via the intermediate transfer belt in order to clean a surface of the intermediate transfer belt; and second driving means for rotating said load limiting driven roll at a predetermined peripheral speed greater than the first speed by what is equivalent to a reduction in the speed of the intermediate transfer belt which is increased by press load derived from said cleaning means.

* * * * *